United States Patent [19]

Fruchard et al.

[11] Patent Number: 4,478,470

[45] Date of Patent: Oct. 23, 1984

[54] ELECTRICAL CONTACT

[75] Inventors: Charles Fruchard, Conflans Sainte Honorine; Jean C. Joly, Osny, both of France

[73] Assignee: AMP Incorporated, Harrisburg, Pa.

[21] Appl. No.: 514,365

[22] Filed: Jul. 18, 1983

Related U.S. Application Data

[63] Continuation of Ser. No. 236,462, Feb. 20, 1981, abandoned.

[30] Foreign Application Priority Data

Mar. 11, 1980 [FR] France ..... 80 05409

[51] Int. Cl.[3] ..... H01R 13/62

[52] U.S. Cl. ..... 339/74 R; 339/258 S

[58] Field of Search ..... 339/74 R, 256 SP, 258 S

[56] References Cited

U.S. PATENT DOCUMENTS

| | | | |
|---|---|---|---|
| 2,625,578 | 1/1953 | Dupre | 339/258 S |
| 3,386,074 | 5/1968 | Woofter | 339/258 S |
| 4,167,299 | 9/1979 | Noguchi | 339/258 S |

FOREIGN PATENT DOCUMENTS

| | | | |
|---|---|---|---|
| 2853512 | 8/1982 | Fed. Rep. of Germany | 339/74 R |
| WO79/00011-59 | 3/1979 | PCT Int'l Appl. | 339/258 S |

*Primary Examiner*—Joseph H. McGlynn
*Assistant Examiner*—Gary F. Paumen
*Attorney, Agent, or Firm*—F. Brice Faller

[57] ABSTRACT

In an electrical contact for mating with a flat tab male contact and comprising a receptacle portion (1) for receiving the male tab and a wire connection portion (2) the whole being stamped and formed from a single piece of sheet metal, the receptacle portion (1) comprising a base (5) and a pair of opposed side walls (6) upstanding from the base (5), free edge portions (7, 8) of the side walls (6) being turned in over the base (5) whereby the base (5), side walls (6) and free edge portions (7, 8) together define a passage to receive from one end a flat tab male contact, one free edge portion (8) is used for establishing an electrical connection to a mated tab while the other free edge portion (7) is used primarily to establish a releasable locked mechanical connection to the mated tab.

2 Claims, 5 Drawing Figures

FIG.1.
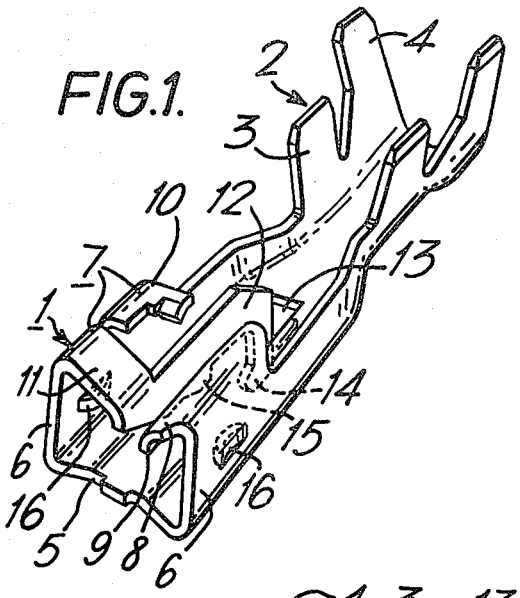
FIG.5.
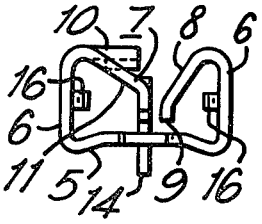
FIG.2.
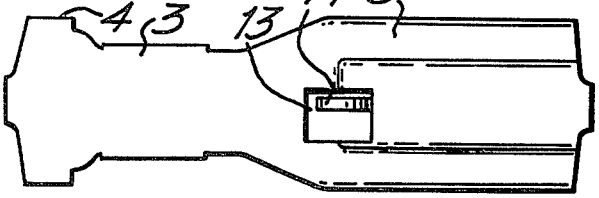
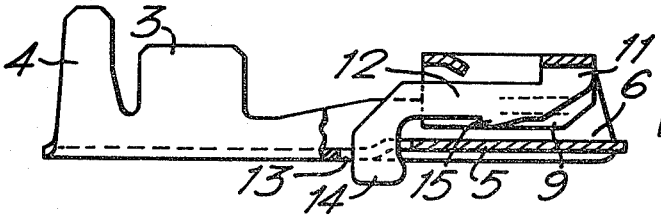
FIG.3.
FIG.4.
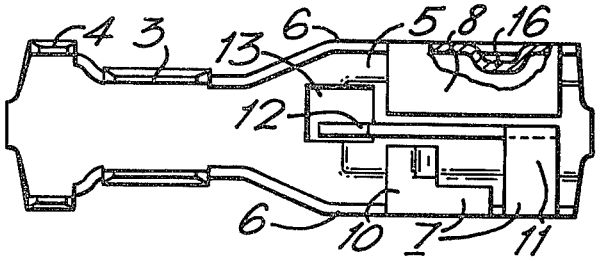

ELECTRICAL CONTACT

This is a continuation of U.S. patent application Ser. No. 236,462 filed Feb. 20, 1981, now abandoned.

This invention relates to an electrical contact, and particularly to an electrical contact for mating with a flat tab male contact and comprising a receptacle portion for receiving the male tab and a wire connection portion the whole being stamped and formed from a single piece of sheet metal.

In our U.S. Pat. No. 3,976,348 there is described such a contact which has the advantages that when mated with a male tab it becomes locked thereto against accidental disconnection, but which is provided with an integral release member by operation of which the locking can be released when required to allow for disconnection.

In particular, in the noted patent there is described an electrical contact having a receptacle portion comprising a base and a pair of opposed side walls upstanding from the base, free edge portions of the side walls being turned in over the base whereby the base, side walls and free edge portions together define a passage to receive from one end a flat tab male contact.

In this known contact the male tab is gripped between the base and both free edge portions of the receptacle portion to provide the necessary electrical contact, and the receptacle portion has a separate tongue within the receptacle portion, which provides the locking to a mated male tab, the free end of the tongue projecting away from the base to form the release member which permits release of the locking to allow for disconnection.

It has now been discovered that satisfactory electrical connection can be achieved using only one of the turned-in edge portions, and that the other edge portion can therefore be used to provide the necessary locking, there thus being no need for a separate tongue.

According to this invention in an electrical contact as set out above one free edge portion is formed with an extension projecting away from the forward, tab-entry end of the receptacle portion beyond the rearward ends of the free edge portions, a free end portion of the extension being turned to extend through a hole in the base of the receptacle portion, the free edge of the extension facing the base of the receptacle portion being formed with a barb adapted to be received in a hole in a flat tab male contact when mated with the receptacle portion thereby to prevent withdrawal of the flat tab male contact from the receptacle portion, the free end portion of the extension constituting a release member pressure on the free end of which towards the base of the receptacle portion serves to move the barb out of the hole in the flat tab male contact to permit withdrawal of the flat tab male contact from the receptacle portion.

An electrical contact according to this invention will now be described by way of example with reference to the drawing in which:

FIG. 1 is a perspective view of the contact;

FIG. 2 is an underneath plan view of the contact;

FIG. 3 is a side view of the contact with part cut away;

FIG. 4 is a top plan view of the contact; and

FIG. 5 is a front view of the receptacle portion of the contact.

The contact to be described is for mating with a flat tab male contact, and comprises a receptacle portion 1 and a wire connection portion 2, the whole being stamped and formed from a single piece of sheet metal.

The wire connection portion 2 comprises a first ferrule 3 for crimping about a bared end portion of the conductor of an insulated wire (not shown), and a second ferrule 4 for crimping about the insulation of the wire, in known manner.

The receptacle portion 1 comprises a base 5 and a pair of opposed side walls 6 upstanding from the base 5, free edge portions 7 and 8 of the side walls 6 respectively being turned in over the base 5 whereby the base 5, side walls 6 and free edge portions 7 and 8 together define a passage to receive from one end (left-hand end in FIG. 1) a flat tab male contact (not shown).

The free edge portion 8 is in one piece, and the free edge 9 thereof is directed towards the base 5 and spaced from the base 5 such that an inserted male tab is gripped between the free edge 9 and the base 5 to provide the required electrical connection between the male tab and the contact, in known manner.

The free edge portion 7 is split by a cut extending from the associated side wall 6, into a rearward part 10 which extends across the base 5 substantially parallel thereto, and a forward part 11 which is directed towards the base 5 firstly obliquely thereto and then substantially at right-angles thereto. At its free end the forward part 11 is formed with an extension 12 in a plane substantially perpendicular to the base 5 and between the free edge portions 7 and 8, and projecting away from the forward, tab-entry end of the receptacle portion 1. The free end of the extension is turned to project through a hole 13 in the base 5 of the receptacle portion 1, to form a release member 14 the function of which will be described later.

This cutting of the free end portion 7 into two axially spaced parts 10 and 11 gives a relatively long spring length for the extension 12 since the part 11 is connected to the associated side wall 6 only for a relatively short distance at the forward, tab-entry end of the receptacle portion.

The edge of the extension 12 facing the base 5 of the receptacle portion 1 is substantially parallel the base 5 of the receptacle portion 1 and is formed with a barb 15 which provides a shoulder facing away from the forward end of the receptacle portion 1. The barb 15 is positioned and adapted to engage in a hole in a male tab when mated with the receptacle portion 1, thereby to prevent withdrawal of the male tab from the receptacle portion 1, the barb 15 being held in the hole in the male tab by the resilience of the forward part 11 of the free edge portion 7 with its extension 12.

Thus, in use of the contact above described, on mating of a standard male tab therewith the tab is gripped between the base 5 and the free edge 9 of the edge portion 8 of the receptacle portion 1, an electrical connection between the contact and male tab thus being provided, and the barb 15 on the extension 12 of the forward part 11 of the edge portion 7 engages in a hole in the tab to prevent withdrawal of the tab from the receptacle portion 1. When it is required to withdraw the male tab from the receptacle portion 1 the release member 14 is urged towards the base 5 of the receptacle portion 1, this lifting the extension 12 and thus lifting barb 15 out of the hole in the male tab, whereby the male tab can be withdrawn as required.

The contact thus provides a reliable, locked but releasable connection to a male tab.

Although the co-operation between the extension 12 and an inserted male tab is primarily intended to provide for locking of the male tab in the receptacle portion 1, it will be appreciated that this co-operation also provides an additional electrical connection between the male tab and the contact.

As shown in the drawings, each side wall 6 of the receptacle portion 1 is formed with an inwardly directed projection 16, and these projections serve as stops limiting movement of an inserted male tab, received between the projections 16 and the base 5 of the receptacle portion 1, away from the base 5. The projections 16 thus serve to prevent damage to the receptacle portion 1 and in particular the free edge portions 7 and 8 by the male tab.

The contact above described can be used in its uninsulated form as described, but is preferably used in an insulating housing (not shown) having means co-operable with the release member 14 of the contact, to urge the release member 14 as required to allow for withdrawal of a male tab mated with the contact. Suitable means of providing for such co-operation are described in U.S. Pat. No. 3,976,348 and will not therefore be described in detail herein.

A connector formed of a contact according to this invention and a suitable insulating housing thus provides the same advantages as those described in U.S. Pat. No. 3,976,348, namely that the connection between the contact and a male tab mated therewith cannot be accidently broken by forces acting on wires connected to the contact and male tab, while the connection can be easily broken when required by appropriate manipulation of the housing containing the contact.

What is claimed is:

1. An electrical contact for mating with a flat tab male contact and comprising a receptacle portion for receiving a male tab and an opposed wire connection portion, the whole being stamped and formed from sheet metal, the receptacle portion comprising a base and a pair of opposed sidewalls upstanding from the base, free edge portions being formed inward from said sidewalls over the base, each said free edge portion having a free edge facing said base, said base, sidewalls and free edges defining a tab entry end and tab receiving passage, characterized in that one free edge portion serves a latching function and the other free edge portion serves an electrical contact function, said one free edge portion comprising an extension in a plane perpendicular to said base and projecting away from the tab entry end of the receptacle, said extension being connected to the respective sidewall by a resilient portion between the sidewall and the extension, said one free edge portion being cut to isolate a part thereof from said extension, said resilient portion remaining at the tab entry end of the receptacle, said free edge of said one free edge portion being on said extension and having a barb adapted to be received in a hole in the male tab for positive latching thereof in said passage, said extension having a free end which extends through a hole in the base, whereby pressure on said free end toward said base deflects the extension away from the base to disengage the barb from the hole to permit withdrawal of the tab from the receptacle.

2. An electrical contact as in claim 1 wherein said resilient portion lies in a plane extending obliquely between said sidewall and said extension.

* * * * *